US005989104A

United States Patent [19]

Kim et al.

[11] Patent Number: 5,989,104

[45] Date of Patent: Nov. 23, 1999

[54] WORKPIECE CARRIER WITH MONOPIECE PRESSURE PLATE AND LOW GIMBAL POINT

[75] Inventors: Inki Kim, Tempe; Chris Karlsrud, Chandler, both of Ariz.; John Natalicio, Los Angeles, Calif.; James Schlueter, Phoenix; Thomas K. Crosby, Gilbert, both of Ariz.

[73] Assignee: SpeedFam-IPEC Corporation, Chandler, Ariz.

[21] Appl. No.: 09/005,889

[22] Filed: Jan. 12, 1998

[51] Int. Cl.[6] ..... B24B 1/00

[52] U.S. Cl. ..... 451/41; 451/287; 451/288; 451/289

[58] Field of Search ..... 451/41, 42, 63, 451/285, 287, 288, 289, 364, 388, 397, 398; 248/288.11, 274.1; 403/119, 152, 171, 170

[56] References Cited

U.S. PATENT DOCUMENTS

| | | |
|---|---|---|
| 3,747,282 | 7/1973 | Katzke . |
| 3,833,230 | 9/1974 | Noll . |
| 4,194,324 | 3/1980 | Bonora et al. . |
| 4,270,314 | 6/1981 | Cesna . |
| 4,625,463 | 12/1986 | Sekiya . |
| 4,811,522 | 3/1989 | Gill, Jr. . |
| 4,918,870 | 4/1990 | Torbert et al. . |
| 5,081,795 | 1/1992 | Tanaka et al. . |
| 5,205,082 | 4/1993 | Shendon et al. . |
| 5,226,636 | 7/1993 | Nenadic et al. . |
| 5,297,361 | 3/1994 | Baldy et al. . |
| 5,335,457 | 8/1994 | Matsuda et al. . |
| 5,377,451 | 1/1995 | Leoni et al. . |
| 5,398,459 | 3/1995 | Okumura et al. . |
| 5,423,558 | 6/1995 | Koeth et al. . |
| 5,476,614 | 12/1995 | Hirose et al. . |
| 5,522,965 | 6/1996 | Chisholm et al. . |
| 5,527,209 | 6/1996 | Volodarsky et al. . |
| 5,533,924 | 7/1996 | Stroupe et al. . |
| 5,554,064 | 9/1996 | Breivogel et al. . |
| 5,571,044 | 11/1996 | Bolandi et al. . |
| 5,584,751 | 12/1996 | Kobayashi et al. . |
| 5,624,299 | 4/1997 | Shendon . |
| 5,681,215 | 10/1997 | Sherwood et al. . |
| 5,716,258 | 2/1998 | Metcalf . |

FOREIGN PATENT DOCUMENTS

| | | |
|---|---|---|
| 0674341 | 9/1995 | European Pat. Off. . |
| 0737546 | 10/1996 | European Pat. Off. . |
| 0747167 | 12/1996 | European Pat. Off. . |

*Primary Examiner*—Timothy V. Eley
*Assistant Examiner*—Derris Holt Banks
*Attorney, Agent, or Firm*—Snell & Wilmer, L.L.P.

[57] ABSTRACT

A carrier for semiconductor wafers to be polished comprises a rigid upper housing, a rigid pressure plate and a gimbal mechanism connecting the plate and housing which permits the plate to gimbal or wobble relative to the housing. The pressure plate is a one-piece component and has a central cut-out portion in which the gimbal mechanism is disposed, thereby establishing a low gimbal point and reducing the incidence of tilting. The gimbal mechanism has an inner bearing ring which is fastened to the underside of the housing, and an outer bearing ring which is fastened to an outer portion of the pressure plate.

10 Claims, 2 Drawing Sheets

WORKPIECE CARRIER WITH MONOPIECE PRESSURE PLATE AND LOW GIMBAL POINT

TECHNICAL FIELD

The present invention relates generally to the art of polishing and planarizing workpieces such as semiconductor wafers, and more particularly, relates to an improved workpiece carrier.

BACKGROUND OF THE INVENTION

A flat disk or "wafer" of single crystal silicon is the basic substrate material in the semiconductor industry for the manufacture of integrated circuits. Semiconductor wafers are typically formed by growing an elongated cylinder or ingot of single crystal silicon and then slicing individual wafers from the cylinder. Multiple layers of conductive material and dielectric material are thereafter built up on the wafer in order to form a multilevel integrated circuit.

The front face of the wafer on which integrated circuitry is to be constructed must be extremely flat in order to facilitate reliable semiconductor junctions with subsequent layers of material applied to the wafer. The removal of projections and other imperfections is referred to in the art as planarization. Material layers applied to the wafer as integrated circuitry is built must also be planarized in order to produce extremely flat surfaces free of irregularities or projections. To this end, chemical mechanical polishing ("CMP") machines have been developed, and are well known in the art, to provide controlled planarization of semiconductor wafers and layers deposited thereon.

CMP machines generally include one or more wafer carriers or "chucks" which retain and carry wafers to be planarized and which press the front faces of the wafers against the surface of a rotating polishing pad. The wafer carrier is also typically rotated to effect relative lateral motion between the polishing pad and wear and planarization of the wafer face due to frictional contact against the pad. An abrasive slurry, such as a colloidal silica slurry, is usually introduced at the pad-wafer interface in order to augment the planarization process.

A conventional prior art wafer carrier 10 which operates in the manner described above is illustrated in FIG. 1. Carrier 10 includes an upper housing 12, a pressure plate 14 mounted underneath a lower or secondary housing 16, and a bearing assembly 18 disposed between lower housing 16 and upper housing 12. A plurality of fasteners 20 (typically eight) fix pressure plate 14 to lower housing 16. A wafer to be polished is held against a backing pad secured to the planar lower surface of pressure plate 14.

Bearing assembly 18 is a "two-axis" bearing. It permits rocking of lower housing 16 and pressure plate 14 relative to upper housing 12 in both the x- and y-directions in order to maintain the surface of the wafer in parallel contact with the polishing pad even when the pad deviates from planarity. This motion is often referred to as "gimballing", and the "gimbal point" is defined as the intersection of the plane in which the x- and y-axes lie with the vertical central axis of the carrier. The gimbal point of prior art carrier 10, for example, is at point 22. The height of the gimbal point above the lower or backing surface of the pressure plate in conventional prior art carriers is approximately 35 mm. Such a high gimbal point has been found to be detrimental, however, as excessive tipping of the wafer with respect to the polishing pad often occurs, causing uneven edge polishing and detracting from uniform pressure distribution across the wafer.

Conventional carriers are also problematic in that the downward pressure applied by the drive shaft is not ideally distributed across the wafer. In carrier 10, for example, upper housing 12 is connected to outer ring 24 of bearing assembly 18 by fasteners 26; while inner ring 28 of bearing assembly 18 is connected to lower housing 16 by fasteners 30. Hence, the pressure distribution path is as follows: downward pressure applied from the drive shaft is transmitted into upper housing 12, transmitted through fasteners 26 and into outer bearing ring 24, transmitted through bearing assembly 18 to inner bearing ring 28, and transmitted through fasteners 30 to the narrow central body portion 32 of lower housing 16 and pressure plate 14. Consequently, the downward pressure is concentrated at the central portion of the wafer and may effect excessive material removal in the inner diameter portions of the wafer, while bowing and inadequate material removal occurs at the outside diameter portions of the wafer.

In order to promote a more uniform distribution of the pressure load, relatively thick backing plates are typically employed. Increasing the thickness of the backing plate to ensure uniform loading, however, necessarily increases the height of the gimbal point which, in turn, may cause the wafer to tilt with respect to the polishing pad and thereby compromise the polishing process.

SUMMARY OF THE INVENTION

The present invention provides a workpiece carrier which addresses and resolves the shortcomings of the prior art described above.

One object of the present invention is to provide a workpiece carrier with a lower gimbal point in order to minimize tipping of the carrier during polishing.

Another object of the present invention is to provide a workpiece carrier in which downward pressure is more evenly distributed across the surface of the workpiece.

In accordance with these and other objects of the present invention, a workpiece carrier is provided comprising a rigid pressure plate, a rigid upper housing, and a gimbal mechanism connecting the plate and housing. The gimbal mechanism permits the plate to pivot about an x-axis and a y-axis relative to the housing. The pressure plate is a one-piece component and the gimbal mechanism is directly attached to the pressure plate, rather than being indirectly attached via an intervening secondary housing. In a preferred embodiment, a central portion of the pressure plate is cut-out so that the gimbal mechanism may be lowered closer to the wafer, thereby lowering the gimbal point and reducing the incidence of tilting.

The present invention also provides a method for uniformly distributing force to a wafer held underneath a pressure plate of a wafer carrier. It comprises the steps of forming the pressure plate such that it has a cut-out central portion of relatively thin cross-section and a surrounding portion of relatively thick cross-section; disposing a gimbal mechanism in the cut-out portion such that a gimbal point is established relatively close to the wafer; disposing a housing over the gimbal mechanism and fastening the housing to an inner diameter portion of the gimbal mechanism; fastening an outer diameter portion of the gimbal mechanism to the surrounding portion of the pressure plate; and applying force to the housing, the force being transmitted from the housing to the inner diameter portion of the gimbal mechanism, through the gimbal mechanism and to the outer portion of the pressure plate, and through the plate to the wafer.

These and other aspects of the present invention are described in full detail in the following description, claims and appended drawings.

BRIEF DESCRIPTION OF THE DRAWINGS

The present invention will hereinafter be described in conjunction with the appended drawing figures, wherein like numerals denote like elements, and.

DETAILED DESCRIPTION OF PREFERRED EXEMPLARY EMBODIMENTS

The subject invention relates generally to the polishing of workpieces such as semiconductor wafers. It will be understood, however, that the invention is not limited to a particular workpiece type or to a particular manufacturing or polishing environment.

Figure 2:
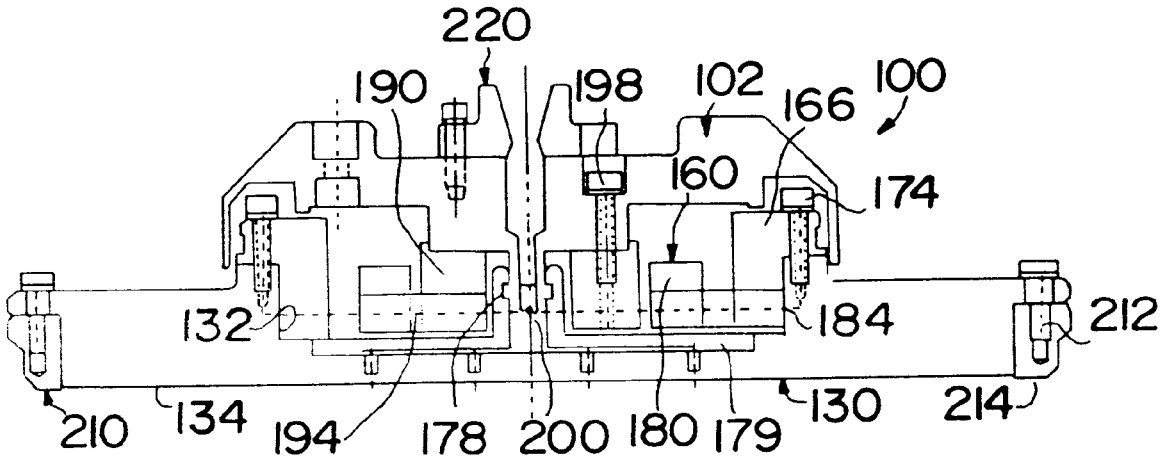
FIG. 2 is a sectional view of a workpiece carrier according to the present invention in which the right half of the figure is rotated ninety degrees relative to the left half of the figure.
Figure 3:
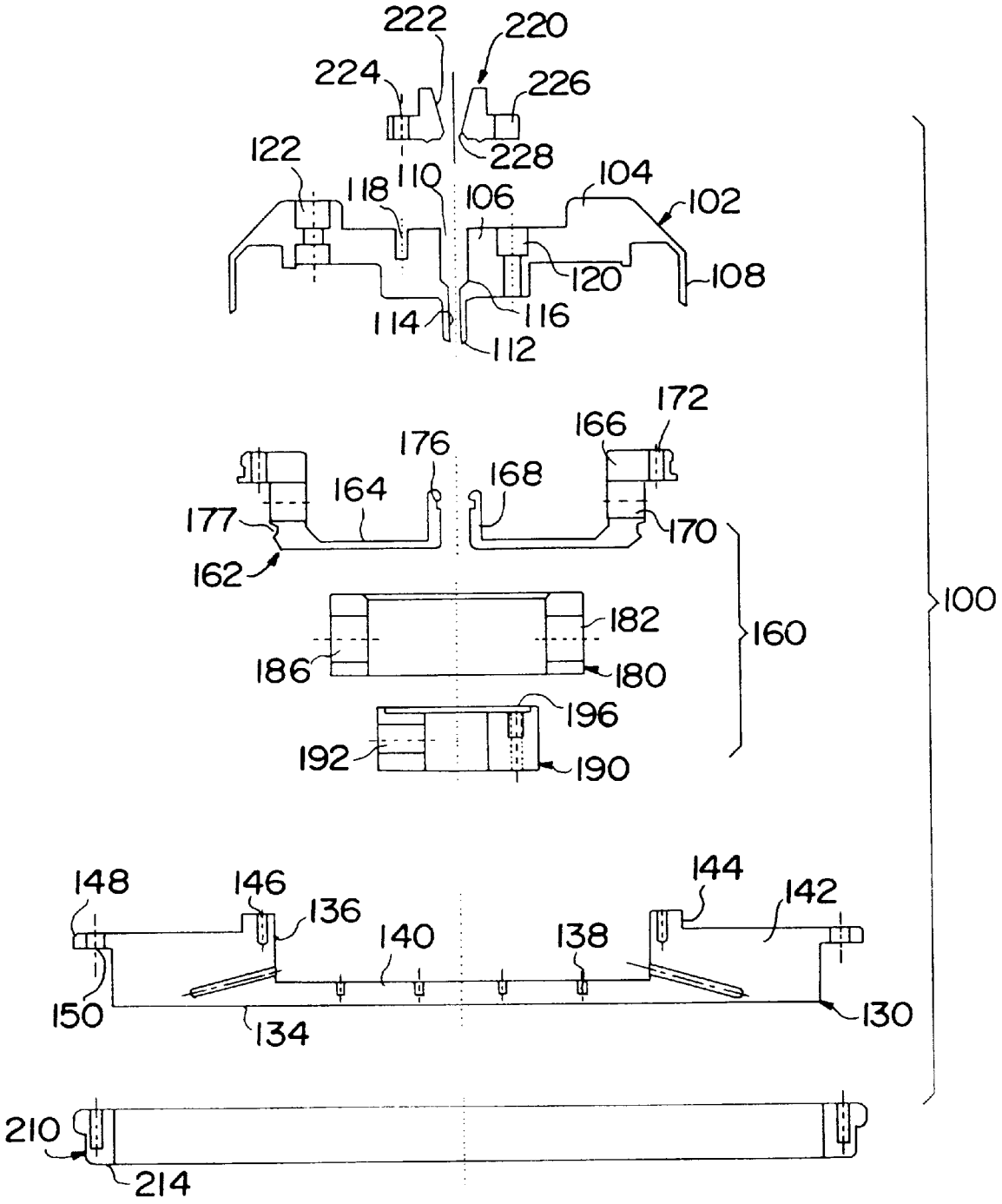
FIG. 3 is an exploded, deconstructed sectional view of the carrier of FIG. 2 showing the individual components of the carrier in which the right half of the figure is rotated ninety degrees relative to the left half of the figure.

FIGS. 2 and 3 depict a workpiece carrier 100 according to the present invention. Typically, carrier 100 would be mounted at the end of a rotatable and vertically movable drive shaft, and above a rotatable polishing platen and pad (not shown). Carrier 100, together with these components, are typically integral components of a chemical mechanical polishing machine or a similar workpiece polishing apparatus. Chemical mechanical polishing machines are well known in the art; a detailed description of their construction and operation may be found in U.S. Pat. No. 5,329,732 to Karlsrud et al., the disclosure of which is incorporated herein by reference.

Carrier 100 comprises a housing 102 centrally mounted above a pressure plate 130. Housing 102 includes an upper housing portion or cover 104 extending between central body portion 106 and downwardly depending outer flanges 108. Flanges 108 protect the inner components of carrier 100 from outside particulates or contaminants. Receptacle 110 is formed through the top of central body portion 106 in alignment with a nose 112 which protrudes from the bottom of body portion 106. Nose 112 defines a smaller diameter through-bore 114 which is continuous with receptacle 110. Frusto-conical shoulder 116 defines the transition between larger diameter receptacle 110 and smaller diameter nose bore 114.

Two fastener bores 118 extend partially into the top of housing body portion 106 on diametrically opposed sides of receptacle 110 (one bore 118 is illustrated on the left side of FIGS. 2 and 3), and two fastener bores 120 are formed completely through body portion 106 in diametric opposition and at ninety degree spaced intervals from bores 118 (one bore 120 is illustrated on the right side of FIGS. 2 and 3). Bores 118 and 120 permit, respectively, attachment of vacuum seal 220 above housing 102 and attachment of gimbal mechanism 160 below housing 102. Housing 102 also includes appropriate means (bores 122, for example) for attaching a drive shaft (not shown) above the housing. The drive shaft imparts upward and downward movement to carrier 100 through, for example, the use of an air cylinder; and also imparts rotational movement to carrier 100 through, for example the use of a servo motor.

Housing 102 is mounted above pressure plate 130. Housing 102 is not rigidly fastened to pressure plate 130, but instead is pivotally attached to pressure plate 130 via gimbal mechanism or bearing assembly 160 (to be described in detail herein). Gimbal mechanism 160 is housed in chamber 132 defined between housing 102 and pressure plate 130.

Pressure plate 130 is a unitary component formed of a rigid material, such as steel. It includes a downwardly-facing, flat backing surface 134 and an upwardly-facing central recess or cut-out section 136. A plurality of vacuum through-holes 138 are formed between recess 136 and backing surface 134. Inside diameter portion 140 of pressure plate 130 is relatively thin, due to the presence of recess 136, while the outside diameter portion 142 surrounding recess 136 is relatively thick. A raised, circular shoulder 144 is formed around the top side of plate 130 between inside diameter portion 140 and outside diameter portion 142 and includes fastener bores 146 formed therein to permit connection to gimbal mechanism 160. An outer rim or lip 148 extends radially outwardly from outside diameter portion 142 and includes bores 150 formed therethrough to permit attachment of retainer ring 210.

As noted above, housing 102 is attached to pressure plate 130 via gimbal mechanism 160, which is disposed in chamber 132 between housing 102 and plate 130. Mechanism 160 comprises bearing support member 162, intermediate bearing ring 180 and inner bearing ring 190. Bearing support member 162 includes a flat lower base 164 extending between an outer bearing ring 166 and a central passageway 168. Outer ring 166 includes two x-axis bores 170 formed therethrough in diametric opposition, and an upper radially-extending flange having vertical fastener bores 172 formed therethrough. Fasteners 174 extend through bores 172 and into bores 146 formed in pressure plate 130 to rigidly attach bearing support member 162 to plate 130. Passageway 168 telescopingly receives nose 112 of housing 102. It includes a groove 176 formed in its inside diameter in which is disposed o-ring 178 to establish a fluid and pressure seal between bearing support member 162 and housing 102. Importantly, should the seal established by o-ring 178 fail, any polishing media or other leakage would flow down and away from carrier 100. Hence, the present seal design takes advantage of gravity in the event of a failure. Carrier 10 illustrated in FIG. 1 utilizes a reversed configuration (see position of o-ring 40) that would allow leakage into the bearing compartment in the event of a failure. The present design essentially inverts the bearing assembly. The inverted bearing assembly also provides advantages in lowering the gimbal point and more uniformly distributing pressure, as will be described in detail below.

An o-ring groove 177 is also formed around the lower outside diameter of outer bearing ring 166 for receipt of an o-ring to establish a seal between pressure plate 130 and bearing support member 162. Together, the seals established by the o-ring in groove 177 and o-ring 178 create a sealed chamber 179 between housing 102, bearing support member 162 and pressure plate 130.

Intermediate bearing ring 180 is nested inside of bearing support member 162 adjacent outer ring 166. Ring 180 includes two diametrically opposed x-axis bores 182 and two diametrically opposed y-axis bores 186. X-axis bores 182 are aligned with x-axis bores 170 formed in outer ring 166. X-axis pins 184 (one pin 184 is illustrated in the right half of FIG. 2) extend through x-axis bores 170 and 182 to permit intermediate ring 180 to pivot about its x-axis relative to outer ring 166.

Inner bearing ring 190 is nested inside of intermediate ring 180 and surrounds raised passageway 168. It includes two y-axis bores 192 formed through its sidewalls in diametric opposition and in alignment with y-axis bores 186 formed in intermediate ring 180. Y-axis pins 194 (one pin 194 is illustrated in the left half of FIG. 2) extend through y-axis bores 186 and 192 to permit intermediate ring 180 to pivot about its y-axis relative to inner ring 190. Inner ring 190 also includes a plurality of vertical fastener bores 196. Fasteners 198 extend through bores 120 formed in housing 102 and into bores 196 in inner ring 190 to rigidly attach inner ring 190 to the underside of housing 102.

The joint formed between plate 130 and housing 102, by virtue of the x-axis and y-axis pivotal connections formed between the components of bearing assembly 160, is sometimes referred to as a gimbal mechanism. It conveys downward pressure and rotation from housing 102 to pressure plate 130, and also permits plate 130 to wobble or rock relative to housing 102. Hence, plate 130 is able to mimic any deviations from planarity of the polishing pad to thereby dynamically and continuously adjust the plane of a wafer held by carrier 100 relative to the polishing pad and to maintain the wafer in parallel and full contact with the polishing pad. The gimbal point is the intersection of the plane containing the x- and y-axes about which the gimballing motion occurs with the central vertical axis of the carrier. Gimballing motion about more than two axes is also envisioned through, for example, the use of additional bearing rings and appropriately positioned axis pins. The gimbal point 200 of carrier 100 can be seen in FIG. 2 immediately underneath nose 114 of housing 102. Gimbal point 200 lies approximately twenty millimeters above pressure plate backing surface 134. By contrast, gimbal point 22 of prior art carrier 10 lies approximately thirty-five millimeters above the backing surface.

Retainer ring 210 is mounted around pressure plate 130 underneath lip 148. Fasteners 212 extend through bores 150 in lip 148 and into corresponding bores formed in ring 210 to fix ring 210 to plate 130. The bottom portion 214 of ring 210 extends slightly beyond backing surface 134 of pressure plate 130 to define a pocket for retaining a wafer to be polished.

A flexible backing pad (not shown) is adhered to pressure plate backing surface 134 to cushion wafers held thereby and to protect the wafers against damage which may result from direct contact with the rigid pressure plate. The rear face of the workpiece rests in parallel contact against the backing pad, while the front face of the workpiece is exposed for parallel contact against the top surface of the polishing pad. The backing pad prevents imperfections or asperities present on the rear face of the wafer from being "telegraphed" through the wafer to its front face, which can result in uneven pressure distribution across the wafer front face against the polishing pad which, in turn, can lead to uneven material removal rates and impaired planarization. The backing pad also frictionally engages the rear surface of the wafer, thereby preventing movement or sliding of the wafer relative to the backing pad. The backing pad, of course, would include vacuum holes formed therethrough in alignment with vacuum holes 138 formed through plate 130.

Vacuum seal 220 is mounted on top of housing 102 and includes a central vacuum shaft 222 in alignment with receptacle 110 of housing 102. Seal 220 includes fastener holes 224 in alignment with fastener holes 118 in housing 102 to permit rigid fixation of seal 220 to housing 102, and may also include cut-out portions 226 to provide access to fastener holes 120. In operation, a vacuum tube (not shown) extends through vacuum shaft 222 and into receptacle 110 of housing 102. Vacuum pressure is introduced into nose shaft 114 and transmitted through sealed chamber 179 to vacuum holes 138 to hold workpieces securely against pressure plate 130 as carrier 100 is lowered towards or lifted away from the polishing pad. An inwardly extending rib 228 is formed around the inside diameter of seal 220 to slightly crimp the vacuum tube and thereby hold it in place.

As noted above, a polishing pad would typically be mounted below carrier 100 on a rotatable polishing platen (not shown). The hardness and density of the pad are selected based on the type of material to be planarized. Blown polyurethane pads, such as the IC and GS series of pads available from Rodel Products Corporation of Scottsdale, Ariz., are often utilized. An abrasive slurry, such as an aqueous slurry of silica particles, is usually pumped onto the pad during polishing operations. The relative movements of carrier 100 and the polishing pad, augmented by the abrasive action of the slurry, produce a combined chemical and mechanical process at the exposed face of a wafer carried by carrier 100 which removes projections and irregularities and produces a substantially flat or planar surface.

Figure 1:
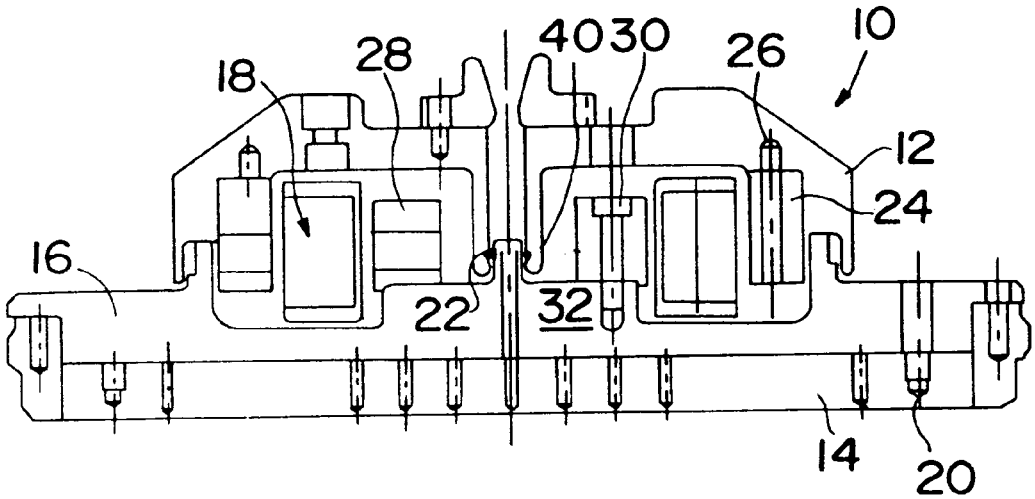
FIG. 1 PRIOR ART
FIG. 1 is a sectional view of a prior art workpiece carrier in which the right half of the figure is rotated ninety degrees relative to the left half of the figure.

The elimination of the conventional two-piece pressure plate and secondary housing configuration, as illustrated in carrier 10 of FIG. 1 and described above, is a critical feature of the present invention and represents a significant advance over conventional carrier designs. The monopiece configuration of the present invention provides numerous advantages over the prior art.

Most importantly, the monopiece design permits a significant and heretofore unachievable lowering of the gimbal point. A low gimbal point is important because as downward pressure is applied to the wafer, drag is generated on the bottom of the wafer. The higher the pressure, the higher the drag that is generated. The drag on the bottom "pulls" and causes the whole carrier assembly to stiffen. If the gimbal is at a high height, the assembly tips significantly in response-causing uneven edge polishing and detracting from a uniform pressure distribution. If the gimbal is at a high enough point, there is even the potential of a wafer flying out of the carrier. Hence, as the gimbal point is lowered, less tipping occurs and the polishing is more uniform.

In past designs, such as that of carrier 10 in FIG. 1, the pressure plate needs to have a certain minimum thickness. Since the lower surface of plate 14 must be machined to a particular flatness profile, if plate 14 is too thin, it is difficult to shape and does not retain flatness well. Moreover, the act of bolting plate 14 to secondary housing 16 requires that plate 14 and housing 16 be of further increased thickness in order to maintain their integrity. Stacking plate 14 and housing 16 still further multiplies the thickness of the assembly and results in a gimbal point 22 that is approximately thirty-five millimeters above the wafer surface. For several reasons, significant efforts have not been made to achieve a lower gimbal point. Thicker backing plates have been favored because the thickness of the backing plate helps to more uniformly distribute the pressure load. Thicker backing plates, however, necessarily raise the gimbal point. Moreover, since industry practice requires that carriers be retrofittable to existing CMP machines, engineers have been reluctant to redesign existing parts.

The carrier of the present invention, conversely, is retrofittable to existing CMP machines and achieves a lower gimbal point. A one-piece pressure plate eliminates thickness-increasing factors such as stacking and bolting. Moreover, maintenance of the outer diameter portions of pressure plate 130 at a relatively higher thickness, permits formation of a recess or cut-out portion 132 into which gimbal mechanism 160 may be lowered without compromise of the ability to machine backing surface 134 to a target flatness profile. By decreasing the thickness of pressure plate 130 and lowering gimbal mechanism 160, the gimbal point may be lowered towards the wafer surface. The present invention achieves a gimbal height of twenty millimeters above the wafer surface, as opposed to a gimbal height in the range of thirty-five millimeters found in conventional carriers.

The configuration of gimbal mechanism 160 is also advantageous in that downward pressure or force is spread out over a larger area or zone than in past designs. Carrier 10, as described above, applies the pressure load to a relatively narrow section of the pressure plate. Downward pressure is transmitted to plate 14 at fastener 30, which is positioned very close to the central vertical axis of the carrier. Fasteners 30 are only at about ⅕ to ¼ of the radius away from the center. In carrier 100, conversely, downward force is transmitted from housing 102, through fasteners 198 into inner bearing ring 190, through bearing assembly via pins 184 and 194 to outer bearing ring 166, and through fasteners 174 into pressure plate 130. Fasteners 174 are spaced approximately ⅔ of the radius of backing surface 134 from the central vertical axis of the carrier, which leads to a much more even distribution of the downward force to the wafer. The inversion of bearing assembly 160 places the larger diameter area of the bearing at the bottom near pressure plate 130, rather than at the top as with prior art carrier 10. This configuration further contributes to a more uniform pressure distribution.

Another advantage of the present invention is that the eight fasteners typically used to attach the secondary housing to the pressure plate (fasteners 20 in FIG. 1, for example) are eliminated. Polishing uniformity is consequently simpler to predict and control because the fasteners are a major source of deflection and movement during polishing. Moreover, the flatness and planarity of the pressure plate relative to the other carrier head components is subject to very strict tolerances and must be precisely controlled. Simply tightening or loosening one of the fasteners between the secondary housing could easily corrupt the planarity of the plate. Making the plate a unitary component alleviates this concern.

Although the foregoing description sets forth a preferred exemplary embodiment of the invention, the scope of the invention is not limited to this specific embodiment. Modification may be made to the specific form and design of the invention without departing from its scope as expressed in the following claims.

It is claimed:

1. A workpiece carrier for carrying a workpiece to be planarized comprising a rigid pressure plate, a rigid upper housing, and a gimbal mechanism connecting said plate and said housing and permitting said plate to pivot about at least two axes relative to said housing, said gimbal mechanism being directly attached to said pressure plate and not being attached to said plate via an intervening secondary housing.

2. A carrier as claimed in claim 1, wherein said at least two axes comprise an x-axis and a y-axis lying in a plane parallel to a planar lower surface of said pressure plate, and a gimbal point is defined by an intersection of said plane with a vertical central axis of said carrier, said gimbal point lying approximately 20 millimeters above said lower surface of said pressure plate.

3. A carrier as claimed in claim 1, wherein said gimbal mechanism comprises an intermediate bearing ring nested inside of a bearing support member, and an inner bearing ring nested inside of said intermediate bearing ring, said inner bearing ring being fastened by first fasteners to an underside of said housing, and said bearing support member being fastened by second fasteners to a topside of said pressure plate.

4. A carrier as claimed in claim 3, wherein said second fasteners are radially spaced from said central vertical axis of said carrier a distance of approximately ⅔ of a radius of said lower surface of said pressure plate.

5. A carrier as claimed in claim 4, wherein said first fasteners are radially spaced from said central vertical axis of said carrier a distance of less than ⅓ of said radius of said lower surface of said pressure plate.

6. A carrier as claimed in claim 1, wherein said pressure plate has a cut-out portion defining a reduced thickness area, and said gimbal mechanism is disposed in said cut-out portion.

7. A carrier as claimed in claim 6, wherein said gimbal mechanism comprises a bearing support member having a flat base, said base being disposed immediately above said pressure plate.

8. A carrier as claimed in claim 7, and further comprising a passageway extending upwardly from a central portion of said flat base, an o-ring groove being formed in an inside diameter of said passageway, and a nose projecting from an underside of said housing and into said passageway, an o-ring being disposed in said groove to form a seal between said housing and said bearing support member.

9. A workpiece carrier for carrying a workpiece to be planarized comprising a rigid pressure plate, a rigid upper housing, and a gimbal mechanism connecting said plate and said housing and permitting said plate to wobble relative to said housing, said pressure plate having a relatively thick outer radial portion and a relatively thin inner radial portion, said gimbal mechanism being disposed adjacent said relatively thin inner radial portion.

10. A method for uniformly distributing force to a wafer held underneath a pressure plate of a wafer carrier comprising the following steps:

forming said pressure plate such that it has a cut-out central portion of relatively thin cross-section and a surrounding portion of relatively thick cross-section;

disposing a gimbal mechanism in said cut-out portion such that a gimbal point is established relatively close to said wafer;

disposing a housing over said gimbal mechanism and fastening said housing to an inner diameter portion of said gimbal mechanism;

fastening an outer diameter portion of said gimbal mechanism to said surrounding portion of said pressure plate; and applying said force to said housing, said force being transmitted from said housing to said inner diameter portion of said gimbal mechanism, through said gimbal mechanism and to said outer portion of said pressure plate, and through said plate to said wafer.

* * * * *